US008756019B2

(12) United States Patent
Pimenov et al.

(10) Patent No.: US 8,756,019 B2
(45) Date of Patent: Jun. 17, 2014

(54) METHOD FOR ESTIMATION OF SAGD PROCESS CHARACTERISTICS

(75) Inventors: Vyacheslav Pavlovich Pimenov, Moscow (RU); Denis Vladimirovich Klemin, Moscow (RU); Denis Vladimirovich Rudenko, Obninsk (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 267 days.

(21) Appl. No.: 13/129,832

(22) PCT Filed: Nov. 28, 2008

(86) PCT No.: PCT/RU2008/000729

§ 371 (c)(1), (2), (4) Date: Aug. 5, 2011

(87) PCT Pub. No.: WO2010/062208

PCT Pub. Date: Jun. 3, 2010

(65) Prior Publication Data

US 2011/0288778 A1 Nov. 24, 2011

(51) Int. Cl.
*G01N 15/08* (2006.01)

(52) U.S. Cl.
USPC ..... 702/12; 702/14

(58) Field of Classification Search
USPC ..... 702/12, 14; 166/60, 272.2, 272.3, 302; 73/19.01, 1.16
See application file for complete search history.

(56) References Cited

U.S. PATENT DOCUMENTS 4,228,855 A 10/1980 Sustek et al.
4,463,803 A 8/1984 Wyatt
4,581,926 A 4/1986 Moore et al.
5,413,175 A 5/1995 Edmunds
2003/0173082 A1* 9/2003 Vinegar et al. ..... 166/272.2
2008/0289821 A1 11/2008 Tsilevich
2008/0289822 A1 11/2008 Tsilevich

FOREIGN PATENT DOCUMENTS

RU 2263210 C2 10/2005

OTHER PUBLICATIONS

Butler et al., "The Gravity Drainage of Steam-Heated Heavy Oil to Parallel Horizontal Wells," Journal of Canadian Petroleum Technology, vol. 20, No. 2, 1981, pp. 90-96.
Nukhaev et al., "A New Analytical Model for the SAGD Production Phase," SPE 102084, 2006, pp. 1-4.
Reis, "A Steam Assisted Gravity Drainage Model for Tar Sands: Linear Geometry," Journal of Canadian Petroleum Technology, vol. 13, No. 10, 1992, pp. 14-20.
Shoham, "Chapter 3: Flow in Pipelines" and "Chapter 6: Two-Phase-Flow Heat Transfer," Mechanistic Modeling of Gas-Liquid Two-Phase Flow in Pipes, Society of Petroleum Engineering: Richardson, 2006, pp: 57-118 and pp. 261-303.

* cited by examiner

*Primary Examiner* — Elias Desta

(57) ABSTRACT

Method comprises measuring temperature along an injection well, measuring a steam quality and an injection rate at an inlet of the injection well and estimating a pressure distribution profile. Then a steam injection profile is estimated using the obtained pressure distribution profile and the measured injection rate combined with a one-dimensional injection well model for pressure losses in the well and heat exchange between an injection well tubing and an annulus. The obtained steam injection profile is used as an input parameter for a set of two-dimensional cross-sectional analytical SAGD models. The models are based on energy conservation law and take into account reservoir and overburden formation properties, heat losses into the reservoir and overburden formation impact on production parameters and SAGD characteristics. SAGD process characteristics are estimated from the set of two-dimensional cross-sectional analytical SAGD models.

3 Claims, 9 Drawing Sheets

Fig. 7 Pressure distribution along the well tubing and annulus

METHOD FOR ESTIMATION OF SAGD PROCESS CHARACTERISTICS

FIELD OF THE INVENTION

The present invention relates to thermally stimulated oil recovery in horizontal wells, namely to the methods for estimation of Steam Assisted Gravity Drainage (SAGD) process characteristics, such as steam flow along the injection well, steam chamber width, oil and water inflow profile.

BACKGROUND ART

Heavy oil and bitumen account for more than double the resources of conventional oil in the world. Recovery of heavy oil and bitumen is a complex process requiring products and services built for specific conditions, because these fluids are extremely viscous at reservoir conditions (up to 1500000 cp). Heavy oil and bitumen viscosity decreases significantly with temperature increases and thermal recovery methods seems to be the most promising ones.

Steam Assisted Gravity Drainage (SAGD) offers a number of advantages in comparison with other thermal recovery methods. Typical implementation of this method requires at least one pair of parallel horizontal wells drilled near the bottom of the reservoir one above the other. The upper well, "injector", is used for steam injection, the lower well, "producer", is used for production of the oil. SAGD provides greater production rates, better reservoir recoveries, and reduced water treating costs and dramatic reductions in Steam to Oil Ratio (SOR).

One of the problems that significantly complicate the SAGD production stage is possibility of the steam breakthrough to the producer. To handle this problem production process requires complicated operational technique, based on downhole pressure and temperature (P/T) monitoring. P/T monitoring data itself do not provide information about production well inflow profile, possible steam breakthrough and location of steam breakthrough zone. P/T measurements interpretation requires full scale 3D SAGD simulation which can not provide real-time answer. Simplified SAGD models (see, for example, Reis L. C., 1992. A steam Assisted Gravity Drainage Model for Tar Sands: Linear Geometry, JCPT, Vol. 13, No. 10, p. 14.)] can be used as the alternative to the SAGD 3D simulations, but existing SAGD simplified models do not account for the transient heat transfer to the reservoir and overburden formation during SAGD production stage and do not account for the presences of the water in formation. Thus P/T interpretation based on these models provides overestimated oil production rate (does not show oil production rate decrease in time) and can not give estimation of the water production, so do not provide information about SOR.

SUMMARY OF THE INVENTION

An aim of the invention is to provide a fast, accurate and efficient method for evaluating SAGD process characteristics, such as steam flow rate along the injection well, steam chamber width, oil and water inflow profile.

The method comprises the steps of measuring temperature along the injection well, steam quality and injection rate at the inlet of the injection well, estimating the pressure distribution profile by using the data obtained, estimating steam injection profile by using the obtained pressure profile and injection rate combined with 1D injection well model for pressure losses in the wellbore and heat exchange between injection well tubing and annulus, using obtained steam injection profile as an input parameter for a set of 2D cross-sectional analytical SAGD models taking into account reservoir and overburden formation properties impact on production parameters and SAGD characteristics, estimation of SAGD process characteristics based on energy conservation law for condensed steam taking into account heat losses into the reservoir and overburden formation and hence the fluid production rate changing in time. An analytical SAGD model is solved using the obtained mathematical solution and enabled the steam chamber geometry and oil and water production rates determination at different times during the SAGD production stage.

In one of the embodiments of the invention temperature along the injection well is measured by distributed temperature sensors.

DESCRIPTION OF THE PREFERRED EMBODIMENT OF THE INVENTION

Figure 1:
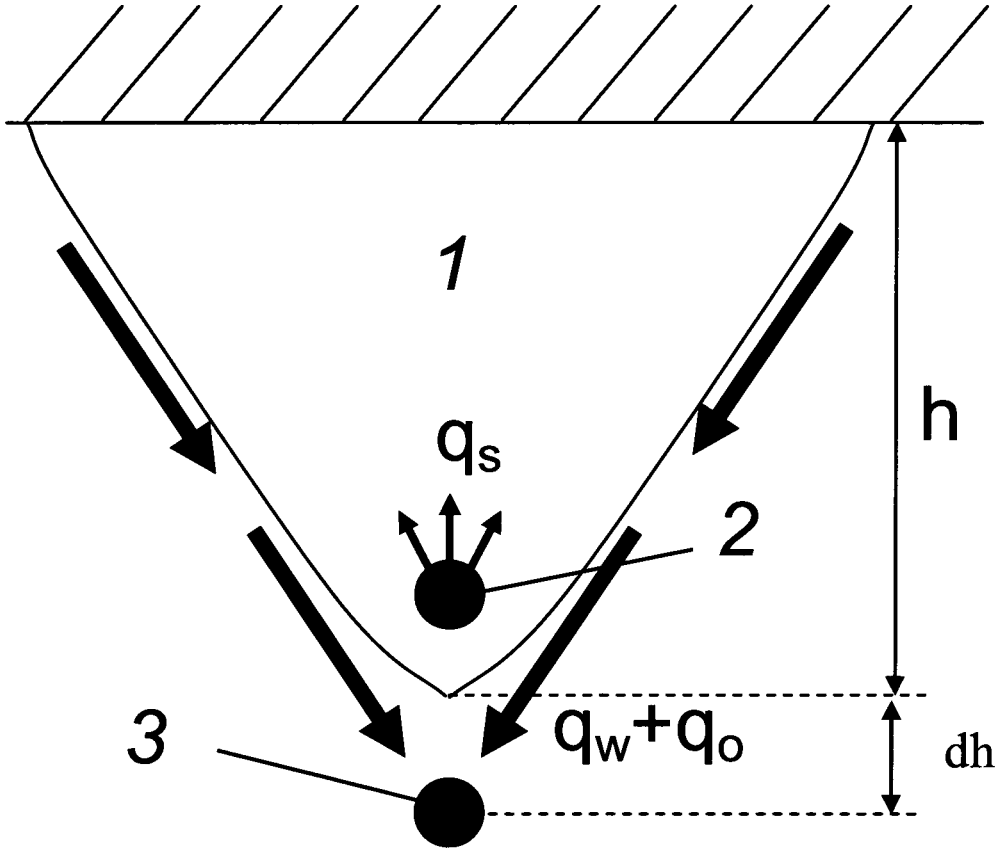
FIG. 1 shows steam chamber geometry where $q_s$ is rate of steam injection, $q_w$ is water production, $q_o$ is oil production rate, h is steam chamber height, dh is a distance between the bottom of the steam chamber and production well, 1—steam chamber, 2—injection well, 3—production well.

Presented invention suggests installing a set of temperature sensors along the injection well. Steam quality and flow rate measurement devices must also be placed at the heel of the injection well. Presented method suggests using the subcool control for the SAGD operation.

Temperature is measured along the injection well, steam quality and injection rate are measured at the inlet of the injection well. Pressure distribution profile (for sections with saturated steam) is estimated by using the data obtained from the presented devices (temperature along the injection well T(1), injection rate q, steam quality at the inlet SQ).

Pressure profile can be found by using the dependence between temperature and pressure for saturated steam for the section with saturated steam.

Then, steam injection profile is measured by using estimated pressure profile and injection rate combined with 1D injection well model for pressure losses (due to friction and mass exchange) in the wellbore and heat exchange between injection well tubing and annulus.

The main assumptions of this model are:

Value of heat exchange between the annulus and formation for production period is negligible small because of the presence of high temperature steam chamber along and around the injection well Heat transfer between the tubing and annulus results in changes in value of steam quality.

Pressure losses due to friction in injection well depend on the amount of steam flow through each well section. Friction loss causes a pressure decrease in the direction of flow. The pressure loss due to friction in a two-phase flow is generally much higher than in comparable single phase flow because of the roughness of the vapor-liquid interface. The pressure gradient due to friction depends upon local conditions, which change in a condensing flow. Therefore, the total pressure effect from friction depends upon the path of condensation.

Pressure profile and injection rate combined with 1D injection well model for pressure losses allows to solve the inversion problem (estimate the steam injection profile). Examples of 1D injection well model can be found in "Mechanistic modeling of Gas-Liquid Two-Phase Flow in Pipes", Ovadia Shoham, Society of Petroleum Engineering, 2006, 57-118, 261-303.

Obtained steam injection profile is an input parameter for a set of 2D cross-sectional analytical SAGD models taking into account reservoir and overburden formation properties impact on production parameters and SAGD characteristics. It is exactly the analytical model that allows us to solve inversion problem fast and with accuracy sufficient for the SAGD process control. Main parameters of this model are: oil viscosity, specific heat of steam condensation, steam quality, water density, difference between steam and reservoir temperature, reservoir volumetric heat capacity, TC values of overburden formation and reservoir. Suggested approach is based on energy conservation law and on iterative procedure for calculation of oil volumetric fraction in produced fluid. Finally, the analytical model gives oil fraction in the produced fluid as function of time, instantaneous and cumulative values of production rate and the information about the growth of the steam chamber. Presented workflow not only provide a information of the growth of steam chamber in the real time, but can predict the future steam propagation in the reservoir and therefore can be use to optimize the SAGD process.

Analytical model is based on energy conservation law for condensed steam and takes into account fluid production rate value and heat losses into the reservoir and overburden formation.

The main assumptions of this model are:

Oil drainage due to gravity in each cross section along the horizontal well during production provides approximately constant Steam Chamber (SC) height and overall production rate slightly vary with time (proved by numerical simulations, Eclipse Thermal).

For approximate simulation of production phase, we assume linear SC geometry (proved by numerical simulations, Eclipse Thermal, FIG. 1).

Basic equation of the model is energy conservation law: steam condensation power is equal to the sum of heat power spent on new SC volume heating, heat losses through the overburden formation and heat losses to the reservoir in front of SC boundary.

Rate of SC volume increase is determined by the reservoir porosity, decrease of oil saturation in SC, and oil production rate.

Water production rate is approximately equal to the sum of steam injection rate and rate of the reservoir water displacement.

Constant Steam Chamber (SC) height (h) results in slightly variation of overall production rate q[$m^3$/m/s] in time (proved by numerical simulations, Eclipse Thermal):

$$q(t)=q_{bg}\cdot\psi(t), \tag{1}$$

where $q_{bg}$ is production rate at the beginning of production with given subcool value, $\psi(t)$ is time function. Overall production rate is a sum of water production (in m3 of cold water) $q_w$ and oil production rate $q_o$.

$$q=q_w+q_o. \tag{2}$$

Rate of water production $q_w$, (m3/m/s) is equal to rate of steam injection $q_s$ (in cold water volume) plus water displaced from the reservoir and minus steam which fills pore volume in SC:

$$q_w = q_s + \phi\cdot\frac{dA}{dt}\cdot\left[(S_{w0}-S_{wr})-\frac{\rho_s}{\rho_w}\cdot(1-S_{wr}-S_{or})\right], \tag{3}$$

where $S_{w0}$ is initial water saturation, $S_{wr}$, is residual water saturation, $S_{or}$, is residual oil saturation, A is SC volume per one meter of the well length, $\phi$ is porosity, $\rho_w$, is water density, $\rho_s$ is steam density.

Obtained on the previous step steam injection profile in combination with the oil volumetric fraction x and water production rate formula (3) can be used to obtain the overall production rates:

$$q=q\cdot x+q_w. \tag{4}$$

Basic equation of the model is energy conservation law: steam condensation power is equal to the sum of heat power spent on new SC volume heating, heat losses to overburden formation and heat losses to the reservoir in front of SC boundary:

$$L\cdot\left(\rho_w\varphi q_s-\rho_s\phi(1-S_{wr}-S_{or})\frac{dA}{dt}\right)\approx c_p\cdot\Delta T\cdot\frac{dA}{dt}+\lambda_0\cdot\Gamma_0\cdot P_{ob}+\lambda\cdot\Gamma\cdot P_r, \tag{5}$$

where L is specific heat of steam condensation, $\phi$ is steam quality, $\Delta T=T_s-T_r$, $T_s$ and $T_r$ are steam and reservoir temperature, $c_p$ is reservoir volumetric heat capacity, $P_{ob}$ is length of SC contact with overburden formation and $P_r$ is length of SC contact with reservoir, $\lambda_0$ and $\lambda$ are thermal conductivity values of overburden formation and reservoir, $\Gamma_0$ and $\Gamma$ are mean values of temperature gradients in overburden formation and in the reservoir in front of expanding SC. Further we use linear SC model: A=h·l, where l is half width of SC at the boundary with overburden formation, h–SC height. In this case $P_{ob}=2\cdot l$ and $P_r=2\cdot\sqrt{h^2+l^2}$.

Non productive well sections are sections with $q_s<q_s^*$: $L\cdot\phi\cdot q_s^*\cdot\rho_w\approx 2\cdot\lambda\Gamma\cdot\bar{h}$, where $q_s^*$ is steam injection rate lower bound for productive sections, $\bar{h}$ is the spacing between injection well and overburden formation.

Rate of SC volume increase is determined by the reservoir porosity, decrease of oil saturation in SC $\Delta S_o=S_{o0}-S_{or}$($S_{o0}$, is initial oil saturation, $S_{or}$ is residual oil saturation), and oil production rate $q_o$:

$$\frac{dA}{dt}\cdot\phi\cdot\Delta S_o=q_o(t). \tag{6}$$

SC volume (A) during production is determined by equation:

$$A(t)=A_p+\frac{1}{\phi\Delta S_o}\int_0^t q_o(t)\,dt, \tag{7}$$

where $$A_p=\frac{Q_{op}}{\phi\cdot\Delta S_o}$$

is the SC volume after preheating stage, t is time from the beginning of production with given subcool. We assume that total time before production with given subcool (preheating+production with varied subcool value) is $t_p\cdot Q_{op}$ (m3/m) is oil volume produced during time $t_p$.

It is convenient to use dimensionless oil production rate: ($q_o=q_{bg}\cdot x$, $q_w=q_{bg}[\psi(t)-x]$) and dimensionless SC half width f=l/h:

$$f(t)=\frac{l_p}{h}+\frac{q_{bg}}{\phi\cdot\Delta S_o\cdot h^2}\int_0^t x\,dt, \tag{8}$$

where $l_p=A_p/h$ l (half width of SC after preheating stage) is free parameter of the model. Instant value of oil fraction in the produced fluid is $x_o=x/\psi(t)$.

Basic energy conservation law (5) can be rewritten in the following form using introduced dimensionless parameters:

$$\psi(t)-x=a\cdot x+b_0(t)+b(t)\cdot\sqrt{1+f(t)^2}, \tag{9}$$

where $$a=\frac{c_p\Delta T}{L\cdot\varphi\cdot\rho_w\cdot\phi\cdot\Delta S_o}+\frac{(S_{w0}-S_{wr})}{\Delta S_o}+\frac{(1-\varphi)\cdot\rho_s\cdot(1-S_{wr}-S_{or})}{\varphi\cdot\rho_w\cdot\Delta S_o}, \tag{10}$$

$$b_0(t)=\frac{2\cdot\lambda_0\cdot\Gamma_0(t)\cdot h}{L\cdot\varphi\cdot q_{bg}\cdot\rho_w}, \tag{11}$$

$$b(t)=\frac{2\cdot\lambda\cdot\Gamma(t)\cdot h}{L\cdot\varphi\cdot q_{bg}\cdot\rho_w}, \tag{12}$$

$\Gamma_0(t)$ and $\Gamma(t)$ are mean values of temperature gradients in overburden formation and in reservoir near the SC boundary.

The unknown value in (9) is oil volumetric fraction x in produced fluid and overall production rate $q(t)=q_{bg}\cdot\psi(t)$. As f(t) depends on x value it is reasonable finding solution of this equation in successive time moments separated by time interval Δt:

$$x_i=\frac{1}{1+a}\cdot\left[\psi(t_i)-b_0(t_i)\cdot f_{i-1}-b(t_i)\cdot\sqrt{1+f_{i-1}^2}\right],\quad f_i=f_{i-1}+\Delta\tau\cdot x_i, \tag{13}$$

where $f_0=l_p/h$ is initial value of dimensionless SC half width; $t_i=(i-1)\cdot\Delta t$ are time steps with i=1, 2, . . . .

$$\Delta\tau=\frac{q_{bg}\cdot\Delta t}{\phi\cdot\Delta S_o\cdot h^2}, \tag{14}$$

where Δτ is dimensionless parameter.

Temperature gradients $\Gamma_0$ and Γ can be estimated using well known formula for temperature gradient in front of heated surface $$\Gamma(t)=\frac{\Delta T}{\sqrt{\pi\cdot\chi\cdot t}}, \tag{15}$$

where $\chi=\lambda/c_p$ is thermal diffusivity

In assumption of constant rate of SC growth (i.e. l~t) mean value of temperature gradient in overburden formation is $$\Gamma_0(t)\approx\frac{1}{l}\int_0^l\frac{\Delta T\cdot dx}{\sqrt{\pi\cdot\chi\cdot t\cdot\frac{l-x}{l}}}=\frac{\Delta T}{(0.5\cdot\sqrt{\pi})\sqrt{\chi\cdot t}}. \tag{16}$$

This formula for temperature gradient $\Gamma_0$ should be corrected to take into account heat transfer before production with given subcool. It leads to decrease of $\Gamma_0$ value:

$$\Gamma_0(t)\approx\frac{\Delta T}{c_0\sqrt{\frac{\lambda_0}{(c_p)_0}(c_{pr0}\cdot t_p+t)}}, \tag{17}$$

where constants $c_o\approx 0.7\div 1.5$, $c_{pr0}$ should be determined from comparison with results of numerical simulations or field data, according to our estimation $c_{pr0}\approx 0.2$.

Temperature gradient Γ can be estimated by similar formula but with different values of constants c and $c_{pr}$. According to our estimation $c\approx 1\div 2.5$, $c_{pr}\approx 0.6$.

$$\Gamma(t)\approx\frac{\Delta T}{c\sqrt{\frac{\lambda}{c_p}(c_{pr}\cdot t_p+t)}}. \tag{18}$$

Overall production rate can be found using (13) and (4) by solving the inverse problem using $q_s(0)$ for estimation $q_{bg}$ and using $x_i$ $q_s(t_i)$ for calculation of $\psi(t_i)$.

Sensitivity study for the wide range of formation thermal properties based on ECLIPSE Thermal simulations provided the background for development and verification of simplified analytical model of SAGD production regime with constant subcool. Results of numerical simulations show that production rate decrease with time can be approximated in the following form:

$$\psi(t) = 1 - \frac{t}{t_q}, \tag{19}$$

where time $t_q$ depends on subcool value, formation properties etc.

Figure 2:
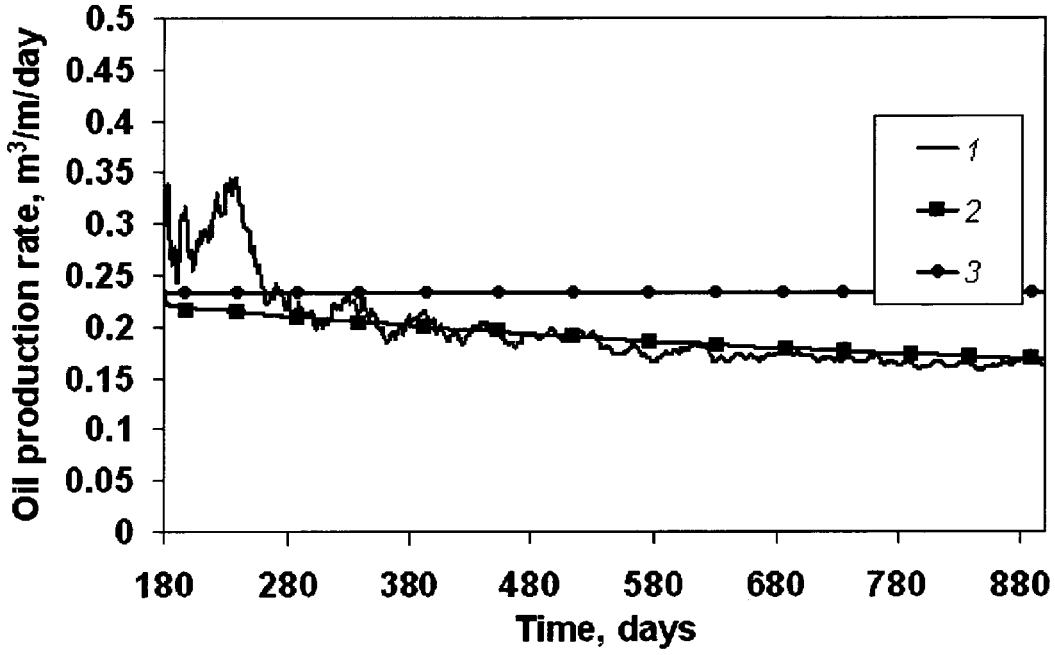
FIG. 2 shows the evaluation of the model with the numerical simulation results using instant oil rate as the parameter: 1—numerical simulation, 2—developed analytical model, 3—Butler's analytical model.
Figure 3:
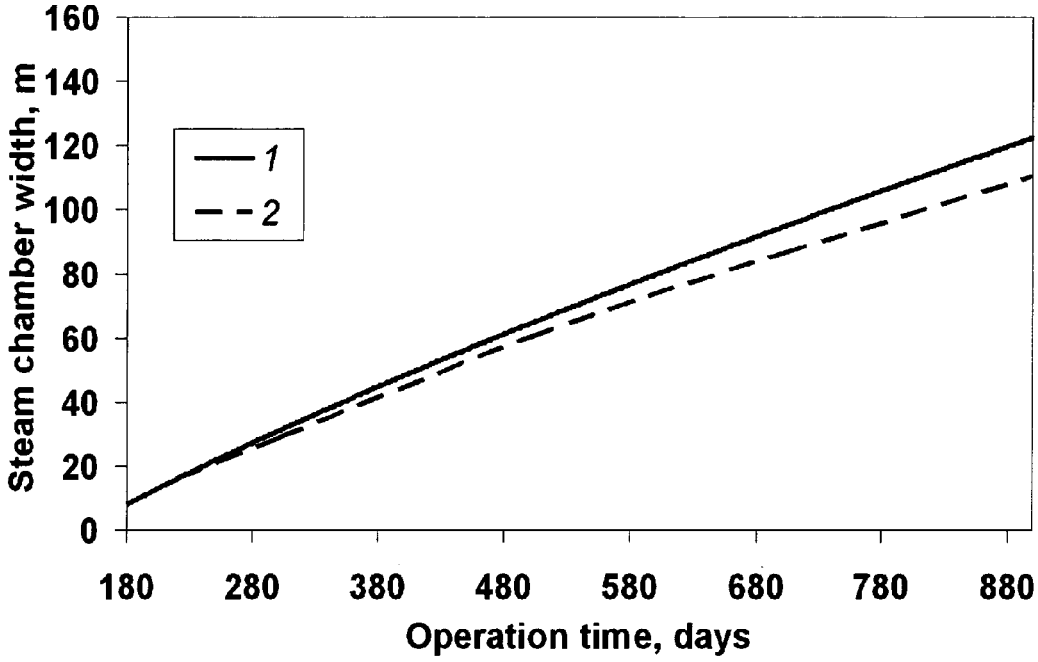
FIG. 3 shows the evaluation of the model with the numerical simulation results for the steam chamber width parameter: 1—developed analytical model, 2—numerical simulation.
Figure 4:
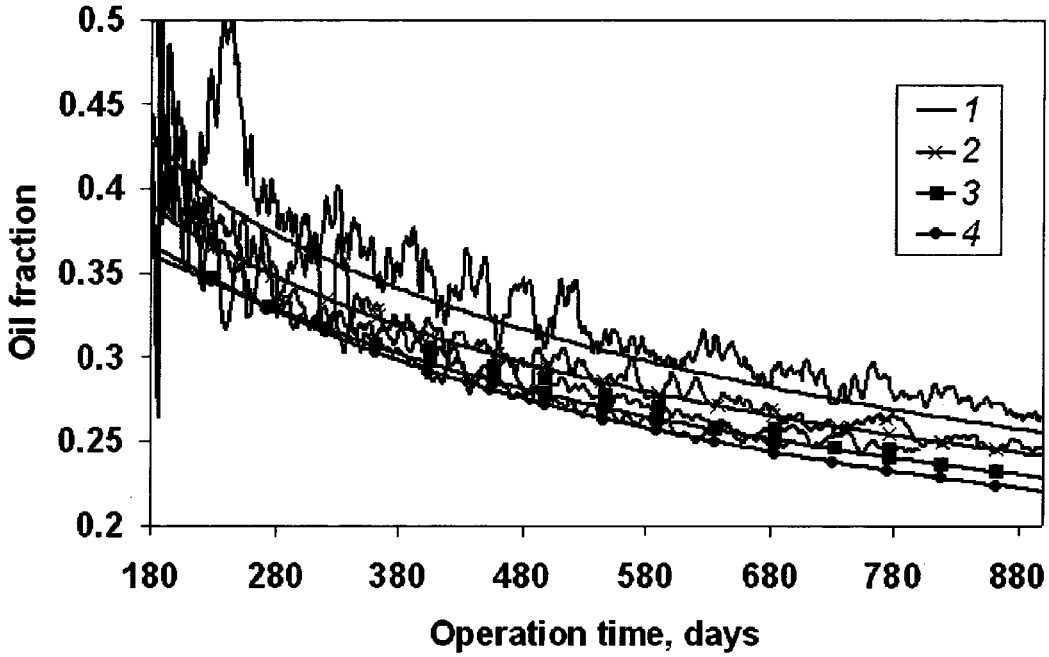
FIG. 4 shows the estimation of the influence of the reservoir thermal conductivities calculated using the SAGD model and evaluation of this model with the results of numerical simulation using the oil volume fraction as the comparison parameter: 1-1 W/m/K, 2—2 W/m/K, 3—3 W/m/K, 4—4 W/m/K.
Figure 5:
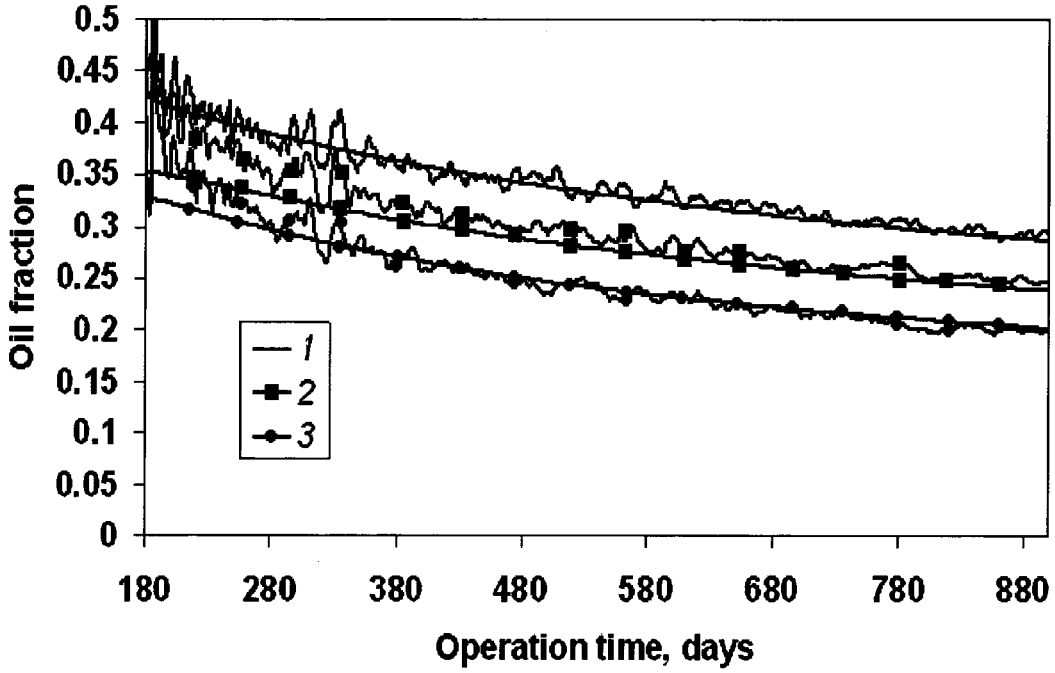
FIG. 5 shows the estimation of the influence of the overburden formation thermal conductivities calculated using the SAGD model and evaluation of this model with the results of numerical simulation using the oil volume fraction as the comparison parameter: 1—1 W/m/K, 2—2.1 W/m/K, 3—5 W/m/K.

Analytical model was implemented in a program. Developed model was successfully tested using Eclipse simulation results for wide range of reservoir and overburden formation thermal properties (FIG. 4 and FIG. 5). Model provides fast and accurate estimation of SAGD production parameters and SC characteristics based on production/injection profile (FIG. 2 and FIG. 3). Computational time for presented model is about 15-60 sec.

Comparison of developed analytical model with numerical simulation and with existing analytical model (Butler, R. M. Stephens. D. J.: "The Gravity Drainage of Steam-Heated Heavy Oil to Parallel Horizontal Wells", JCPT 1981.) (which doesn't account transient heat transfer to the reservoir and overburden formation during SAGD production stage), is shown on FIG. 2. Butler's model provides overestimated oil production rate (does not show oil production rate decrease in time) in comparison with numerical simulation results. Developed analytical model results for production rate are very close to numerical simulation.

Connection between production parameters and production/injection profile gives background for real time P/T monitoring of SAGD.

Let's consider the SAGD process case with following reservoir model, based on the data from one of the Athabasca tar sands field. The reservoir model was homogeneous with permeability equal to 5 Darcy. The thickness of oil payzone is 20 meters. The porosity is equal to 30%. The reservoir depth is 100 m. The formation temperature 5° C. and pressure 10 bar. Reservoir thermal conductivity 1.83 W/m/degK, overburden formation thermal conductivity 2.1 W/m/degK, reservoir volumetric heat capacity 1619.47 kJ/m3/C, overburden formation volumetric heat capacity 2500 kJ/m3/C, initial oil saturation 0.76, residual oil saturation 0.127 and initial water saturation is equal to the residual 0.24. Oil viscosity at the reservoir conditions 1650000 cP.

Figure 6:
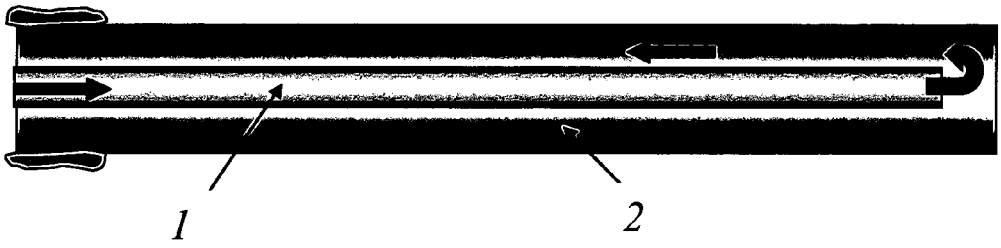
FIG. 6 shows an injection well completion used in the example of application: 1—steam flow in tubing (without mass exchange), 2—steam flow in annulus (with mass exchange).

SAGD case well completion (FIG. 6): length of horizontal section 500 m, the values of internal and outer diameters of the annulus and tubing: ID tubing 3", OD tubing 3.5", ID casing 8.625", OD casing 9.5". The heat capacity of tubing/casing is 1.5 kJ/kg/K, thermal conductivity of tubing/casing is 45 W/m/K, the wellbore wall effective roughness 0.001 m. The spacing between injection and production well is 5 meters.

The injection well operating conditions in the considered SAGD case: injection rate is about 110.8 m3/day (in liquid water volume) the steam is injected through the toe of the well. Value of steam quality at the tubing inlet of the horizontal well section is 0.8 with the injection pressure 11 bar, temperature at the tubing inlet is 185° C. For the production well, the steam chamber control procedure was modeled using saturation temperature control.

As the reference data the direct 3D SAGD numerical simulation results on the Eclipse Thermal were used. For the 3D SAGD process simulation the reservoir dimensions were: 100 m width, 20 m height, 500 m long. The computational domain consists of 60×10×60 cells and simulates one half of the payzone. The cells sizes near the wells are reduced to 0.25 m, to provide accurate description of the temperature front propagation during the production and near wellbore effects.

Pressure distribution along the injection well was calculated using measured downhole T(1)-temperature along the injection well, q-injection rate q and SQ-steam quality at the inlet.

Figure 7:
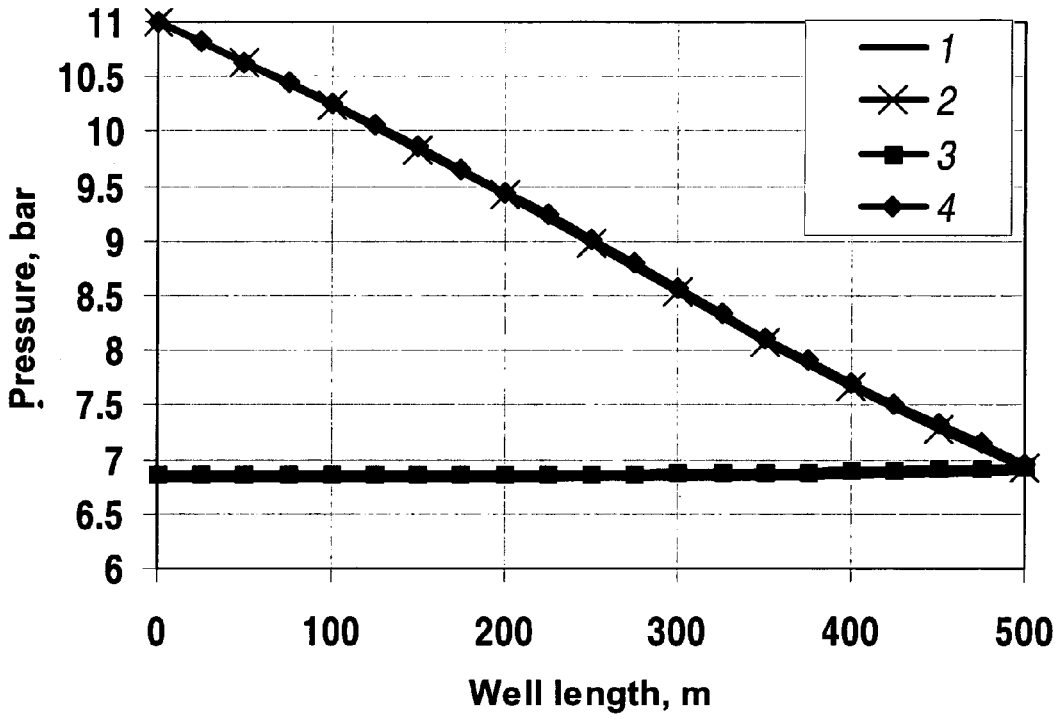
FIG. 7 shows the comparison of the simulated and reference pressure distribution along the well tubing and annulus: 1—reference data in annulus, 2—reference data in tubing, 3—simulated profile in annulus, 4—simulated profile in tubing.

The simulated pressure profile along the tubing and annulus is presented on the FIG. 7. Reasonably good agreement with reference results was observed.

Steam injection profile was estimated using the injection pressure estimated at step 1 and injection rate combined with 1D injection well model for pressure losses (due to friction and mass exchange) in the wellbore and heat exchange between injection well tubing and annulus.

Figure 8:
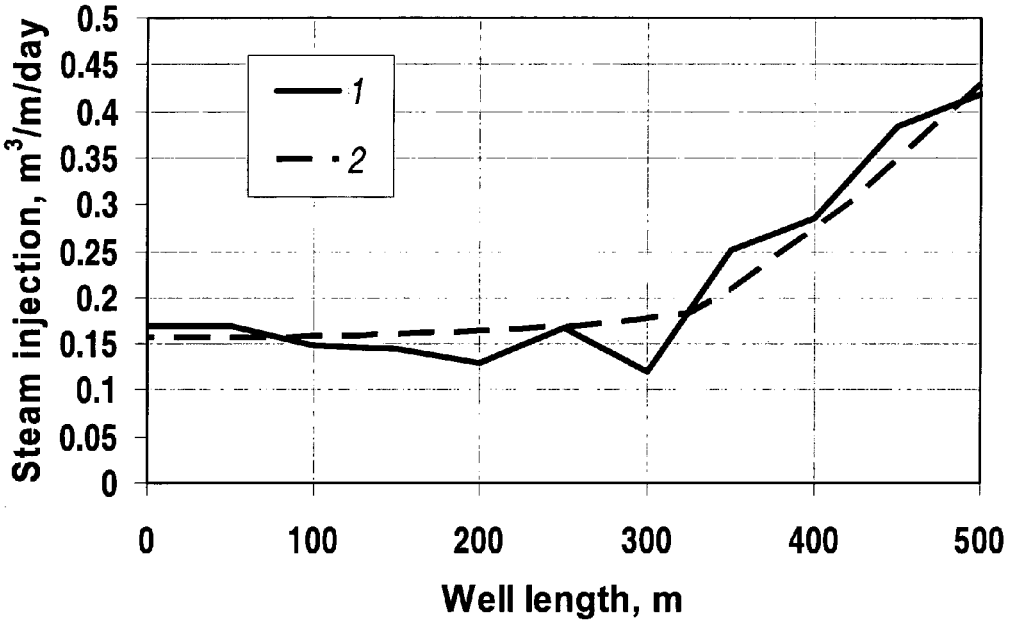
FIG. 8 shows a steam injection profile (the amount of steam injected at each 1 m of injection well) comparison with the reference data: 1—injection profile reference data, 2—simulated injection profile.

The steam injection profile comparison with the reference data is presented on FIG. 8 (the amount of steam injected at each 1 m of injection well).

Obtained steam injection profile as well as temperature, pressure, steam quality profiles were used as input parameters for a set of 2D cross-sectional analytical SAGD models.

Figure 9:
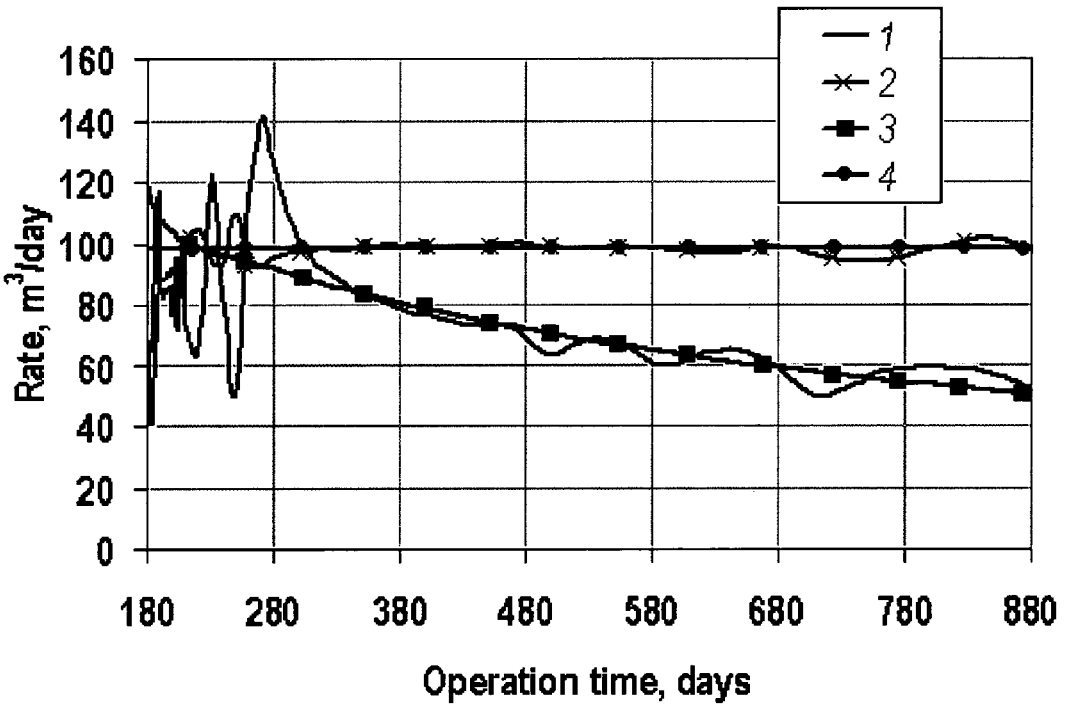
FIG. 9 shows the comparison of the analytical model results for production rate with the reference data: 1—oil rate reference data, 2—water rate reference data, 3—simulated analytical model oil rate, 4—simulated analytical model water rate.

Analytical model give oil fraction in the produced fluid as function of time, instantaneous and cumulative values of production rate and the information about the growth of the steam chamber. Developed analytical model results for production rate (FIG. 9) were very close reference data.

The invention claimed is:

1. A method for estimation of Steam Assisted Gravity Drainage (SAGD) process characteristics, comprising:

measuring temperature along an injection well drilled in a reservoir by downhole sensors, measuring a steam quality and an injection rate at an inlet of the injection well, estimating a pressure distribution profile along the injection well using the measured temperature, steam quality and injection rate, estimating a steam injection profile using the obtained pressure distribution profile and the measured injection rate combined with a one-dimensional injection well model for pressure losses in the well and heat exchange between an injection well tubing and an annulus, using the obtained steam injection profile as an input parameter for a set of two-dimensional cross-sectional analytical SAGD models, the models are based on energy conservation law taking into account reservoir and overburden formation properties, heat losses into the reservoir and overburden formation impact on production parameters, SAGD characteristics, and estimating the SAGD process characteristics from the set of two-dimensional cross-sectional analytical SAGD models by a computer.

2. The method of claim 1 wherein the temperature is measured by distributed temperature sensors installed along the injection well.

3. The method of claim 1 wherein the SAGD characteristics comprise steam chamber geometry and oil and water production rates.

* * * * *